US008798892B2

(12) United States Patent
Wehmeier et al.

(10) Patent No.: US 8,798,892 B2
(45) Date of Patent: Aug. 5, 2014

(54) METHOD AND DEVICE FOR THE DYNAMIC MONITORING OF A LAMBDA PROBE

(75) Inventors: Kersten Wehmeier, Ludwigsburg (DE); Michael Pfeil, Marbach am Neckar (DE); Siyun Chu, Marbach am Neckar (DE); Albrecht Clement, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 493 days.

(21) Appl. No.: 13/170,808

(22) Filed: Jun. 28, 2011

(65) Prior Publication Data

US 2011/0314892 A1 Dec. 29, 2011

(30) Foreign Application Priority Data

Jun. 29, 2010 (DE) ..... 10 2010 030 632

(51) Int. Cl.
*F02D 41/00* (2006.01)

(52) U.S. Cl.
USPC ..... 701/103; 701/109; 123/672

(58) Field of Classification Search
USPC ..... 701/103, 109; 123/672, 690, 704; 60/276, 285; 73/114.69, 114.71, 73/114.72, 114.73
See application file for complete search history.

(56) References Cited

U.S. PATENT DOCUMENTS

| | | | | |
|---|---|---|---|---|
| 5,656,765 | A * | 8/1997 | Gray | 73/23.32 |
| 8,146,352 | B2 * | 4/2012 | Parnin | 60/297 |
| 8,151,560 | B2 * | 4/2012 | Zanini-Fisher et al. | 60/297 |
| 8,572,952 | B2 * | 11/2013 | Parnin | 60/297 |
| 2012/0186329 | A1 * | 7/2012 | Yacoub et al. | 73/23.31 |
| 2013/0180510 | A1 * | 7/2013 | Makki et al. | 123/672 |

* cited by examiner

*Primary Examiner* — Hai Huynh
(74) *Attorney, Agent, or Firm* — Michael Best & Friedrich LLP

(57) ABSTRACT

A method for the dynamic monitoring of a first lambda probe arranged in an exhaust-gas duct of an internal combustion engine upstream of an exhaust-gas purification system. A period of an output signal of the first lambda probe is determined in a controller of the internal combustion engine, and a lambda regulating signal is determined from an output signal of a second lambda probe connected downstream of the exhaust-gas purification system. A first threshold value for a lengthening of the period of the output signal of the first lambda probe is predefined, in that a characteristic signal (46) is derived from the lambda regulating signal, in that a second threshold value for an inadmissible deviation of the characteristic signal (46) is predefined, and in that an inadmissible asymmetric delay of the first lambda probe is inferred if the lengthening of the period exceeds the first threshold value and the characteristic signal (46) deviates from the second threshold value outside predetermined limits.

10 Claims, 2 Drawing Sheets

METHOD AND DEVICE FOR THE DYNAMIC MONITORING OF A LAMBDA PROBE

BACKGROUND OF THE INVENTION

The invention relates to a method for the dynamic monitoring of a first lambda probe arranged in an exhaust-gas duct of an internal combustion engine upstream of an exhaust-gas purification system, a period of an output signal of the first lambda probe being determined in a controller of the internal combustion engine, and a lambda correction being determined from an output signal of a second lambda probe connected downstream of the exhaust-gas purification system.

The invention also relates to a method for detecting a defect upstream of a second lambda probe arranged in an exhaust-gas duct of an internal combustion engine and connected downstream of an exhaust system, a lambda correction being determined in a controller of the internal combustion engine from an output signal of the second lambda probe.

The invention also relates to a device for the dynamic monitoring of a first lambda probe arranged in an exhaust-gas duct of an internal combustion engine upstream of an exhaust-gas purification system, a circuit arrangement or a program sequence being provided in a controller of the internal combustion engine, by means of which circuit arrangement or program sequence a period of an output signal of the first lambda probe can be determined, and a second lambda probe for determining a lambda correction being connected downstream of the exhaust-gas purification system.

Lambda probes are used in the exhaust tract of internal combustion engines to measure the oxygen content of the exhaust gas in order to control the composition of the air/fuel mixture of the internal combustion engine. Lambda probes may be designed as step probes, the output signal of which falls abruptly from 0.9 V to 0.1 V in the event of a change of the lambda value from 0.995 to 1.005. The output signal of the lambda probe is supplied to an engine controller which controls the metering of the fuel in such a way that, temporally on average, a lambda value of lambda=1 is adhered to, at which the catalytic converters arranged in the exhaust tract provide their optimum purification action. If a lambda probe ages, this can lead to a delayed reaction of the output signal to lambda changes, a so-called impairment of dynamics. In this way, the composition of the exhaust gas may intermittently deviate from a value suitable for an optimum purification action of the catalytic converters. Legal regulations therefore stipulate that the aging of the lambda probe must be monitored with regard to an impairment of its dynamics. A slowing of the reaction of the lambda probe can be detected from a lengthening of the period of the lambda regulation, which can therefore be taken into consideration as a criterion for aging.

If the delay of the reaction of the lambda probe is asymmetrical with regard to rich-lean and lean-rich lambda changes, this can lead to a change in the mean lambda value controlled by the engine controller, as a result of which the purification action of the catalytic converters is particularly disadvantageously reduced. This may be observable even in the case of a delay which cannot be detected from period-based monitoring.

If a leak occurs in the exhaust tract upstream of the second lambda probe, air can be sucked into the exhaust-gas duct and, by means of its oxygen content, increase the lambda value determined by the second lambda probe. As a result, an undesirably rich mixture is supplied to the internal combustion engine.

SUMMARY OF THE INVENTION

It is therefore an object of the invention to provide a method which can detect an asymmetrical delay of the reaction of the output signal of a lambda probe.

It is therefore also an object of the invention to provide a method which can detect a leak in the exhaust-gas duct upstream of the second lambda probe.

It is also an object of the invention to provide a device for monitoring an asymmetrical delay of a lambda probe.

The object of the invention relating to the method for detecting an asymmetrical delay of a lambda probe is achieved in that a first threshold value for a lengthening of the period of the output signal of the first lambda probe is predefined, in that a characteristic signal is derived from the lambda regulating signal, in that a second threshold value for an inadmissible deviation of the characteristic signal is predefined, and in that an inadmissible asymmetric delay of the first lambda probe is inferred if both the lengthening of the period exceeds the first threshold value and also the characteristic signal deviates from the second threshold value outside predetermined limits. The derivation of a characteristic signal from the lambda regulating signal, determined by means of the second lambda probe connected downstream of the exhaust-gas purification system, or from a signal derived from said lambda regulating signal, using the proportional and integral components of the output signal of the second lambda probe permits a faster detection of an asymmetrical delay than is possible from the period of the lambda signal of the first lambda probe and from the integral component, as is conventionally used in the prior art, of the lambda signal of the second lambda probe. Instead of the absolute period, a lengthening of the period of the output signal of the first lambda probe may also serve as a measure, and a threshold value may be predefined for this. By means of the method according to the invention, it is possible, as prescribed, for an asymmetrically delayed reaction of the first lambda probe to be detected within three driving cycles.

In a particularly advantageous embodiment, the characteristic signal is determined from the lambda regulating signal by virtue of the lambda regulating signal being limited to in each case a predefinable minimum value and maximum value and being filtered with a time constant of between 5 seconds and 50 seconds, preferably with a time constant of 10 seconds. This permits a particularly fast settling time of the characteristic signal, and therefore a fast detection of an asymmetrical delay of the first lambda probe.

An undesirably early response of the detection of an asymmetrical delay may be avoided by virtue of an inadmissible asymmetrical delay of the first lambda probe being inferred if, beyond a predefined time span, both the lengthening of the period exceeds the first threshold value and also the characteristic signal deviates from the second threshold value outside predetermined limits.

The object of the invention relating to the method for detecting a leak upstream of the second lambda probe is achieved in that, from the lambda regulating signal, a leakage signal is determined by virtue of the lambda regulating signal being limited to in each case a predefinable minimum value and maximum value and being filtered with a time constant of between 5 seconds and 50 seconds, preferably with a time constant of 10 seconds, and in that a leak is inferred if, in a load-speed range with high pulsation of the lambda value, the leakage signal lies further in the lean direction than a predefinable threshold value. In the event of a leak, oxygen enters from the ambient air, which oxygen is compensated by the lambda regulation based on the output signal of the second lambda probe. A leak has the effect that, in a selected load-speed range with high pulsation, for example around zero load at 2000 revolutions per minute, the leak signal is higher to an inadmissible extent than the steady-state value of the rest of the operating characteristic map. Since a leak acts only in the "lean" direction, it is necessary to monitor only a threshold in the "rich" direction.

The object of the invention relating to the device is achieved in that the controller of the internal combustion engine comprises a circuit arrangement or a program sequence by means of which an inadmissible asymmetrical delay of the first lambda probe can be inferred from a comparison of the period of the output signal of the first lambda probe with a threshold value and a comparison of a characteristic signal determined from the lambda regulating signal with predefined threshold values. By means of the device, it is possible to realize a passive diagnostic method for an asymmetrically delayed lambda probe. An active intervention of the lambda regulator based on the output signal of the first lambda probe is therefore not necessary.

BRIEF DESCRIPTION OF THE DRAWINGS

The invention will be explained in more detail below on the basis of an exemplary embodiment illustrated in the figures, in which.

DETAILED DESCRIPTION

Figure 1:
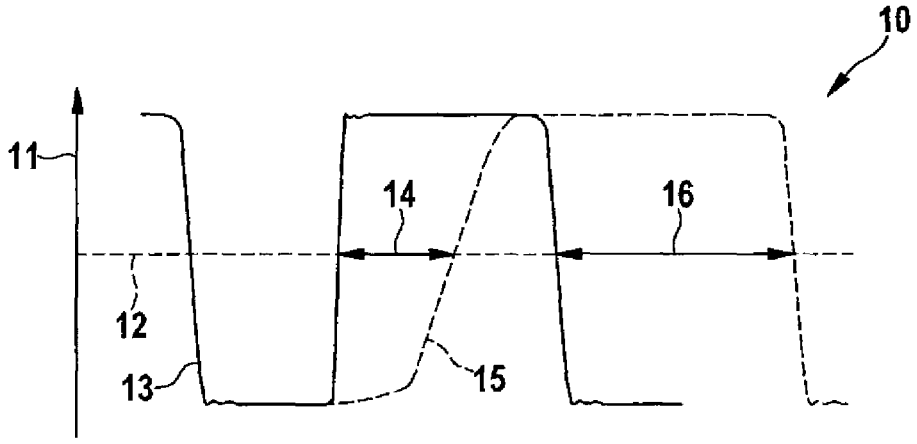
FIG. 1 shows a profile of output signals of an intact and of an asymmetrically delayed lambda probe.

FIG. 1 shows a first lambda signal diagram 10 in which a lambda signal 13 of a first lambda probe arranged in an exhaust-gas duct of an internal combustion engine upstream of an exhaust-gas purification system is shown along a first signal axis 11 and a first time axis 12. If such a lambda probe ages asymmetrically, such that the output signal of the lambda probe reacts with a delay in the case of a lambda value varying in the "lean" direction, a delayed lambda signal 15 is generated which is delayed in relation to the lambda signal 13 by a probe delay 14. In this asymmetrically delayed lambda signal 15, voltage increases are slower than increases of the lambda signal 13, whereas the voltage decreases take place at the same speed. The period of the delayed lambda signal 15 is longer than the period of the lambda signal 13 by a period lengthening 16.

Figure 2:
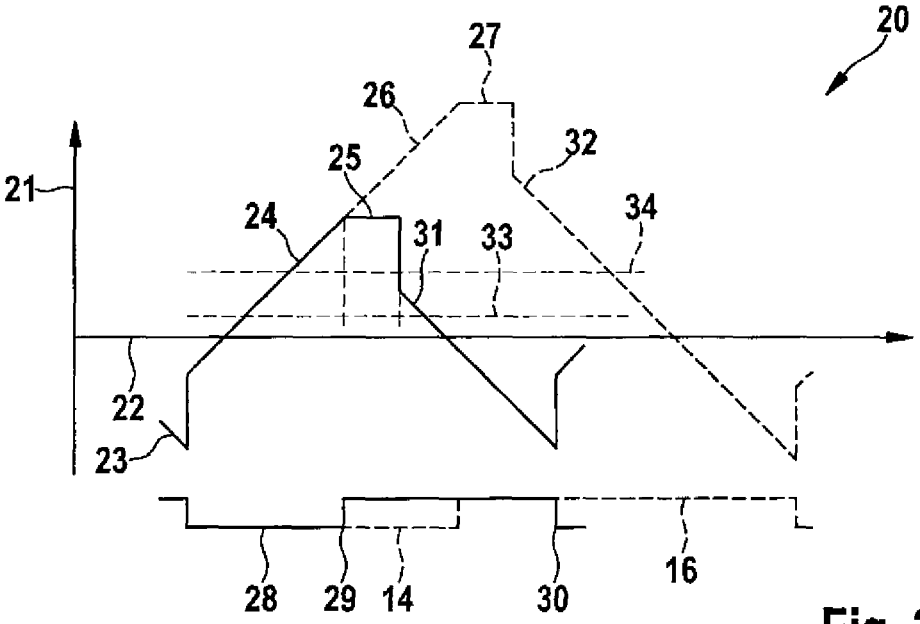
FIG. 2 shows a signal profile of a two-position regulator in the case of a lambda probe with an asymmetrical probe delay.

FIG. 2 shows a regulation signal diagram 20 of a signal profile of a two-position regulator based on the output signal of the first lambda probe. The signal diagram 20 shows a regulating signal 23 along a second signal axis 21 and a second time axis 22. The regulating signal 23 has a rising ramp 24, a first delay time 25 and a normal falling ramp 31. A lean-rich signal 28 has a lean-rich step 29 occurring at the same time as the end of the rising ramp 24. At the end of the normal falling ramp 31, the lean-rich signal 28 has a rich-lean step 30. The described signal profile with the normal delay time 25 has a normal centroidal axis 33 with which the normally conventional lambda shift is attained, which takes place here in the direction of slight enrichment.

As a result of the unidirectional delay of the lambda probe, a lengthening of the rising ramp 24 by a rise lengthening 26 takes place until, after the probe delay 14, the probe signal steps from "lean" to "rich". This is followed by a second delay time 27 which is of the same length as the first delay time 25. Over the further course of the signal profile, via a lengthened falling ramp 32, the signal returns to the non-delayed level and then continues in the same way as the normally falling ramp 31. The period lengthens by more than the delay time of the lambda probe, the period lengthening 16 takes effect. The period lengthening 16 is dependent on the ratio of step and ramp component and may, for example in the case of a dominant ramp component, amount to twice the value of the delay time of the probe, as is the case in the example illustrated in FIG. 2. This results in a longer residence time on the rich side than on the lean side, as a result of which the trimmed centroidal axis 34 lies further into the rich range than the normal centroidal axis 33 which should be set for an optimum purification action of the exhaust-gas purification system.

Figure 3:
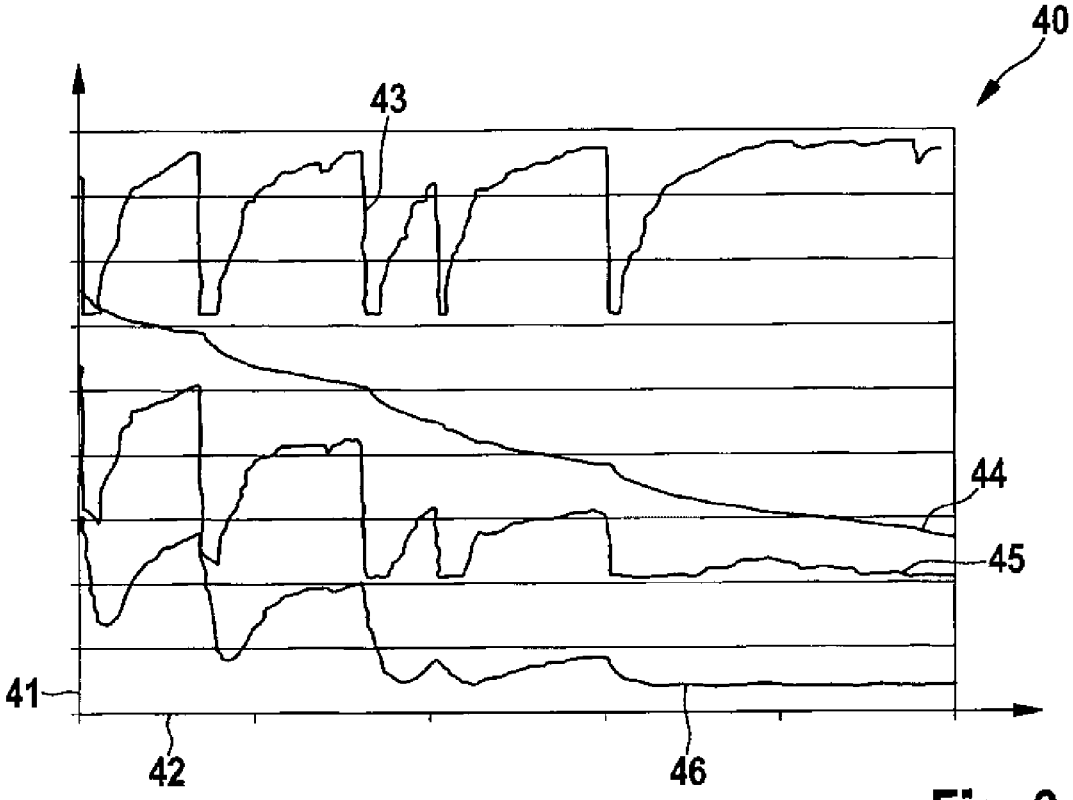
FIG. 3 shows a signal profile of a characteristic signal which has been determined according to the invention from a lambda regulating signal.

FIG. 3 shows a signal analysis diagram 40 in which a proportional component 43 and an integral component 44 of a lambda regulating signal of a post-cat regulation arrangement of the internal combustion engine are shown along a third signal axis 41 and a third time axis 42. The post-cat regulation arrangement serves for the correction of lambda deviations on the basis of the output signal of a second lambda probe connected downstream of the exhaust-gas purification system in the exhaust-gas duct of the internal combustion engine. Here, the integral component 44 is used for the correction of the lambda deviations. According to the invention, a characteristic signal 46 is attained from the integral component 44 taking into consideration the proportional component 43. For this purpose, the sum of the integral component 44 and proportional component 43 is limited to predefinable threshold values, and thus form the limited lambda regulating signal 45. From the limited lambda regulating signal 45, the characteristic signal is attained by means of a time filter with a filter constant of between 5 and 50 seconds, typically a filter constant in the region of 10 seconds. From the signal analysis diagram 40, it can be clearly seen that the characteristic signal 46 settles more quickly than the integral component 44, and a faster detection of an asymmetrical delay of the first lambda probe is therefore made possible.

The invention claimed is:

1. A method for the dynamic monitoring of a first lambda probe arranged in an exhaust-gas duct of an internal combustion engine upstream of an exhaust-gas purification system, a period of an output signal of the first lambda probe is determined in a controller of the internal combustion engine, and a lambda regulating signal is determined from an output signal of a second lambda probe connected downstream of the exhaust-gas purification system, characterized in that a first threshold value for a lengthening of the period of the output signal of the first lambda probe is predefined, in that a characteristic signal (46) is derived from the lambda regulating signal, in that a second threshold value for an inadmissible deviation of the characteristic signal (46) is predefined, and in that an inadmissible asymmetric delay of the first lambda probe is inferred if the lengthening of the period exceeds the first threshold value and the characteristic signal (46) deviates from the second threshold value outside predetermined limits.

2. The method according to claim 1, characterized in that the characteristic signal (46) is determined from the lambda regulating signal by virtue of the lambda regulating signal being limited to a predefinable minimum value and maximum value and being filtered with a time constant of between 5seconds and 50 seconds.

3. The method according to claim 2, characterized in that the time constant is about 10 seconds.

4. The method according to claim 1, characterized in that an inadmissible asymmetric delay of the first lambda probe is inferred if the lengthening of the period exceeds the first threshold value and the characteristic signal (46) deviates from the second threshold value outside predetermined limits.

5. The method according to claim 4, characterized in that the inadmissible asymmetric delay of the first lambda probe is inferred if the lengthening of the period exceeds the first threshold value and the characteristic signal (46) deviates from the second threshold value outside predetermined limits occur beyond a predefined time span.

6. Device for the dynamic monitoring of a first lambda probe arranged in an exhaust-gas duct of an internal combustion engine upstream of an exhaust-gas purification system, a controller of the internal combustion engine configured to determine a period of an output signal of the first lambda probe, and a second lambda probe connected downstream of the exhaust-gas purification system for determining a lambda regulating signal, characterized in that the controller of the internal combustion engine determines an inadmissible asymmetrical delay of the first lambda probe exists based on a comparison of the period of the output signal of the first lambda probe with a threshold value and a comparison of a characteristic signal (46) determined from the lambda regulating signal with predefined threshold values.

7. The device according to claim 6, wherein the controller includes a circuit arrangement which determines the period of the output signal of the first lambda probe.

8. The device according to claim 6, wherein the controller includes a circuit arrangement which determines the inadmissable asymmetrical delay of the first lambda probe exists.

9. The device according to claim 6, wherein the controller includes a program sequence which determines the period of the output signal of the first lambda probe.

10. The device according to claim 6, wherein the controller includes a program sequence which determines the inadmissable asymmetrical delay of the first lambda probe exists.

* * * * *